United States Patent [19]

Goldie et al.

[11] Patent Number: 4,496,917

[45] Date of Patent: Jan. 29, 1985

[54] RF-PRIMED HIGH POWER HALOGEN VIAL APPARATUS

[75] Inventors: Harry Goldie, Randallstown; William D. Cherry, Beltsville, both of Md.

[73] Assignee: The United States of America as represented by the Secretary of the Air Force, Washington, D.C.

[21] Appl. No.: 422,430

[22] Filed: Sep. 23, 1982

[51] Int. Cl.[3] ..... H01P 1/14

[52] U.S. Cl. ..... 333/13; 315/39

[58] Field of Search ..... 333/13, 99 PL; 315/39

[56] References Cited

U.S. PATENT DOCUMENTS 3,644,779 2/1972 Goldie ..... 333/13 X

FOREIGN PATENT DOCUMENTS 519922 12/1955 Canada ..... 333/13

*Primary Examiner*—Eugene R. LaRoche
*Assistant Examiner*—Benny Lee
*Attorney, Agent, or Firm*—Donald J. Singer; William Stepanishen

[57] ABSTRACT

A high power halogen-filled vial stage receiver protector utilizing an RF priming source in conjunction with a pair of circular guides to provide a continuous supply of priming free electrons to the halogen gas-filled plasma limiter vial.

7 Claims, 1 Drawing Figure

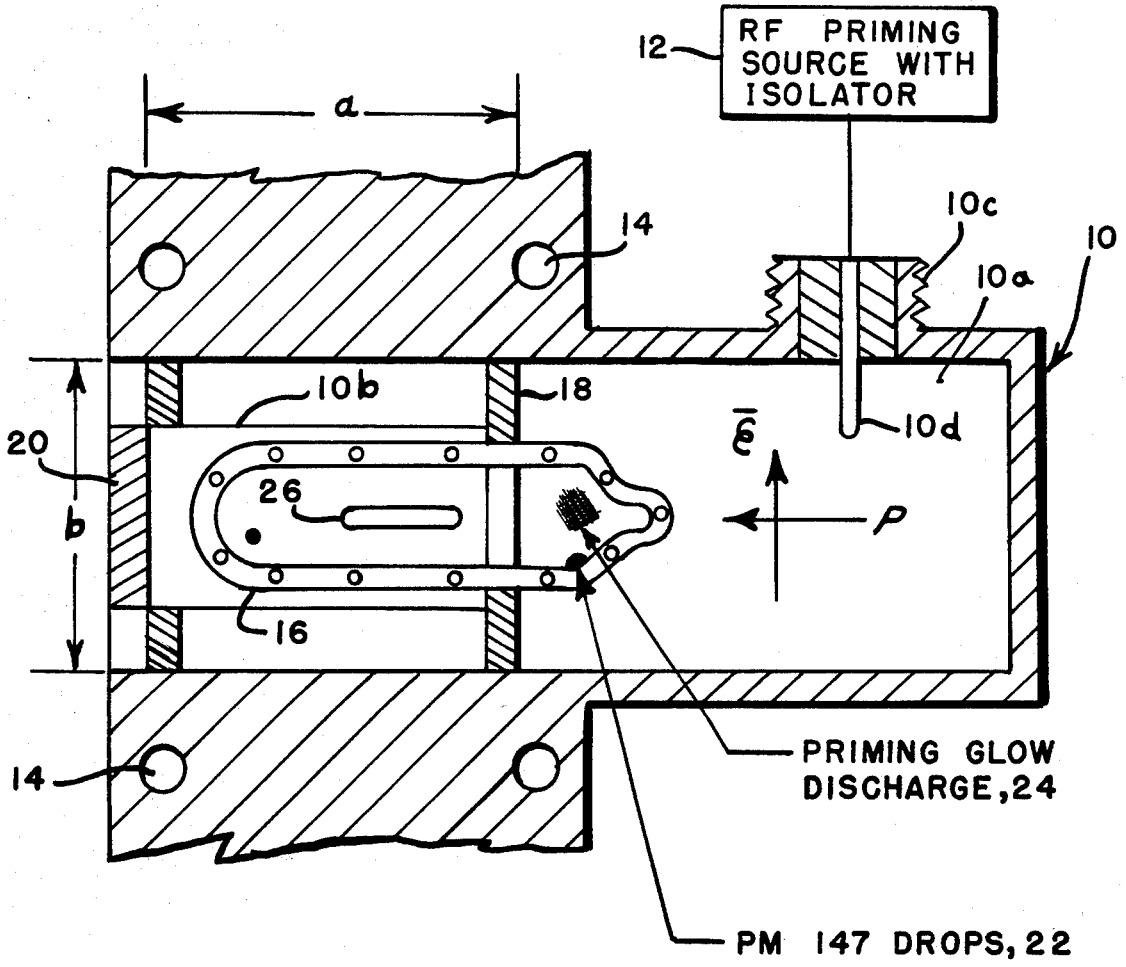
RF PRIMING SOURCE WITH ISOLATOR
12
a
14
10c
10
10a
10b
18
20
10d
$\bar{E}$
26
b
P
16
14
PRIMING GLOW DISCHARGE, 24
PM 147 DROPS, 22

RF-PRIMED HIGH POWER HALOGEN VIAL APPARATUS

STATEMENT OF GOVERNMENT INTEREST

The invention described herein may be manufactured and used by or for the Government for governmental purposes without the payment of any royalty thereon.

BACKGROUND OF THE INVENTION

The present invention relates broadly to radar receiver protectors, and in particular to an RF-primed high power halogen vial receiver protector apparatus.

At microwave frequencies, the mixer which is the input circuit to a radar receiver is very susceptible to damage by large applied signals, and therefore must be carefully protected. This sensitivity to damage is especially true of crystal mixers which are generally utilized in radar receiver. In the prior art, receiver protective system has been disclosed that are particularly applicable to radar systems wherein the receiver and transmitter are connected to the same antenna, thus making it necessary to protect the receiver during the interval of time when the transmitter is in operation. It is also necessary to protect the radar receiver when it is near some other transmitter, such as, for example, another radar that is operating at nearly the same frequency, because the adjacent transmitter may impress a signal of a sufficient amplitude to injure the radar receiver.

Practically all modern day radar systems utilize a duplexing section which contains a T-R switch to permit the use of a single antenna for both transmitting and receiving. Generally, the T-R switches comprise some type of gas discharge tube. If the gas discharge tube is fired by a pulse which is derived from the transmitted signal, a small amount of power may get into the mixer section of the receiver prior to ignition of the gas discharge tube by the transmitter derived pulse. In order to prevent this situation, prepulsing systems have been employed.

One of the problems associated with high power vial stages used in waveguide receiver protectors is the lack of stable breakdown. This is mainly due to the absence of free electron priming or a keepalive. Since vial stages primarily use halogen gases to achieve a fast recovery period under the incidence of very high microwave power, the use of metallic keepalive electrodes is precluded. This is true because halogens will react with all metals to form metallic halides. Thus, the gases will adhere to the electrode surfaces and will materially decrease the operating pressures within the vial that will cause the stage to fail. Since the vial stage is always in the high power rf input stage, gas cleanup is a critical factor in its operating lifetime. The present invention provides an RF-primed high power halogen vial apparatus which utilizes a unique method to obtain free electrons (keepalive) in the vial stage without introducing metal electrodes to the halogen gas. In this manner, a first pulse breakdown will occur and the gas discharge will occur repeatedly early in the incident rf pulse waveform without undergoing a statistically-varying formative time lag.

SUMMARY OF THE INVENTION

The present invention utilizes a high power halogen vial receiver protector apparatus which is primed with RF energy from a RF priming source. The high power vial apparatus in the waveguide receiver protectors are provided with the free electrons for the priming or keepalive function and will thereby achieve a stable gas discharge. The vial stage which is filled with a low pressure halogen gas is positioned in a circular guide that has a tuning iris in alignment with the input receiver's waveguide. An RF priming signal from an external source is applied through a larger circular guide to the vial stage. The dielectric constant of the quartz vial in combination with the diameter of the circular guide in which it is positioned, does not allow the propagation of the RF priming power to leave the vial stage.

It is one object of the present invention, therefore, to provide an improved RF-primed high power halogen vial apparatus.

It is another object of the invention to provide an improved RF-primed high power halogen vial apparatus wherein free electrons are provided on a continuous basis to a waveguide-type receiver protector.

It is a further object of the invention to provide an improved RF-primed high power halogen vial apparatus wherein a halogen gas-filled plasma limiter is utilized as a receiver protector.

It is still another object of the invention to provide an improved RF-primed high power halogen vial apparatus wherein RF excitations are applied to a circular guide to provide priming electrons.

It is yet another object of the invention to provide an improved RF-primed high power halogen vial apparatus wherein a stable gas breakdown is maintained in a high power vial stage of a waveguide receiver protector.

These and other advantages, objects and features of the invention will become more apparent after considering the following description taken in conjunction with the illustrative embodiment in the accompanying drawing.

BRIEF DESCRIPTION OF THE DRAWINGS

The sole FIGURE is a cross-sectional view of the RF-primed high power halogen vial apparatus according to the present apparatus.

DESCRIPTION OF THE PREFERRED EMBODIMENT

Referring now to the FIGURE, there is shown a cross-sectional view of the RF-primed high power halogen vial apparatus which comprises housing member 10 that includes a first and second circular guide 10*a*, 10*b*. The first circular guide 10*a* has positioned at one end a connector means 10*c* which is utilized to introduce the RF priming energy into the first circular guide 10*a*. An RF priming source 12 with isolator is shown connected to the connector means 10*c*. The center conductor 10*d* of the connector means 10*c* enters the first circular guide 10*a* region perpendicular to the longitudinal or central axis of the first circular guide 10*a*.

The second circular guide 10*b* is positioned in that area of the housing member 10 which is in alignment with a radar receiver's input rectangular waveguide. The diameter of the circle that defines the second circular guide 10*b* is smaller than the diameter of the circle that defines the first circular guide 10*a*. The dimensions a, b represent the height and broadwall width respectively of a standard WR90 rectangular waveguide. However, it should be well understood that the dimensions, a, b may be adjusted to suit the requirements of any particular special application. The housing member 10 is provided with mounting holes 14 which permit the receiver protector unit to be mounted directly to and in line with a radar receiver's input waveguide so that radar signals will pass through the quartz vial 16 to the radar receiver.

There is mounted within the second circular guide 10*b* along its central axis a thin wall quartz vial 16. The thin wall quartz vial 16 which is filled with a low pressure gas has a diameter that is slightly smaller than the diameter of the second circular guide 10*b* in which it is mounted. The gas-filled vial 16 which substantially fills the area defined by the second circular guide 10*b*, extends into one end of the region which is defined by the first circular guide 10*a*. There is positioned between the first and second circular guides 10*a*, 10*b*, a circular guide step 18 which prevents the RF priming power energy from entering the region defined by the second circular guide 10*b*. The circular guide step 18 also provides the means by which the gas-filled vial 16 is supported within the second circular guide 10*b*. Access to the gas-filled vial 16 is accomplished by means of the circular end cap 20 which is positioned in the outer wall of the housing member 10 in alignment with the second circular guide 10*b*.

The thin-wall quartz vial 16 contains, in addition to a low pressure gas of the halogen group, a few drops 22 of promethium 147. Promethium 147 is a metallic element of the rare-earth group which may be obtained as a fission product of uranium or from neutron-irradiated neodymium. The drops 22 of promethium 147 are positioned in that portion of the gas-filled vial 16 which protrudes into the region which is defined by the first circular guide 10*a*. The promethium 147 drops 22 are utilized as an aid to promoting the priming glow discharge 24 which occurs as a result of the interaction of the RF priming power and the low pressure halogen gas.

There is positioned in the second circular guide 10*b* a vial stage tuning iris 26. The vial stage tuning iris 26 is located along the central axis of both the second circular guide 10*b* and the thin-wall quartz vial 16. The vial stage tuning iris 26 which is positioned off-center with respect to the center line of the waveguide dimension, a, is in the receiver main signal path. It may be noticed that, when the halogen gas-filled plasma limiter vial 16 is fully ionized, the radar signal energy in the region of the second circular guide is effectively and completely prevented from passing therethrough to possibly damage the radar receiver.

The RF-primed high power halogen vial apparatus operates in the following manner. The circular quartz vial, which is of conventional design, is placed in a circular bore whose diameter, since it is smaller than the diameter of the first circular guide 10*a* operates in conjunction with the effects of the quartz vial dielectric constant, such that it will not allow propagation of the RF priming power out of the quartz vial. The stepup to the larger diameter circular guide at one end of the vial is designed so as to propagate the RF priming power to the quartz vial. This RF energy which is estimated at about 5 watts CW and when coupled to the low pressure gas in the vial, will create a weakly-ionized plasma. This plasma or weak glow is the source of the free electrons that is needed to provide a first pulse breakdown and eliminate the statistical variation of discharge time lags. A synchronous pulsed RF for electron priming can also be used.

A few microcuries of promethium 147 radioactivity is inserted in a conventional way to enhance the starting characteristics of the RF-priming discharge. The promethium 147 is placed near the vial end in which the glowball is contained.

The RF priming frequency is selected so that it propagates through the larger circular guide, but not through the smaller circular waveguide and that it is not a subharmonic of the radar's operating frequencies. The strength of the cw or pulsed priming power will depend on the gas pressure and coupling efficiency but should not exceed 5 watts. The priming source may, for example, be a 6 GHz IMPATT or FET oscillator which is operating in a prepulsed (referenced to the RF transmitter pulse) mode so the gas discharge glow is on before the rf pulse arrives. Alternatively, the priming source may operate in the CW mode.

This method of RF priming is applicable to high power solid state limiters which cannot operate on overload mode; i.e., when an arc occurs in a radar feed. Under this temporary failure condition, full rf power, which is normally 10 times the limiter power-handling rating, will be developed and the limiter will be destroyed. With a simple one stage gas discharge type of power limiter this overload condition is not a problem since plasma limiters can handle enormous power levels for several seconds.

Although the invention has been described with reference to a particular embodiment, it will be understood to those skilled in the art that the invention is capable of a variety of alternative embodiments within the spirit and scope of the appended claims.

What is claimed is:

1. An RF-primed high power halogen vial apparatus as a radar receiver protector comprising in combination:

a housng member containing a first and second cylindrical guide, said first cylindrical guide being longitudinally aligned with said second cylindrical guide; said second cylindrical guide being in alignment with the input waveguide to said radar receiver, a vial means positioned within said second cylindrical guide with a small portion extending into said first cylindrical guide, said vial means containing a low pressure gas, a tuning iris formed in said second cylindrical guide, said tuning iris being substantially centered with respect to said vial means, and an RF priming means operatively connected to said first cylindrical guide, said RF priming means applying an RF priming signal into said first cylindrical guide by means of a single electrode which is positioned within said first cylindrical guide external to and not in contact with said vial means, said first cylindrical guide propagating said RF priming signal into said vial means to ionize the gas therein and create a weakly-ionized plasma, said plasma providing a source of free electrons to provide a stable breakdown upon receipt of a high microwave signal.

2. An RF-primed high power halogen vial apparatus as described in claim 1 wherein said vial means comprises a circular quartz vial whose dielectric constant, in cooperation with the diameter of said second cylindrical guide, prevents the propagation of said RF primary signal therefrom.

3. An RF-primed high power halogen vial apparatus as described in claim 1 wherein said low pressure gas comprises a gas from the halogen group.

4. An RF-primed high power halogen vial apparatus as described in claim 3 including a few microcuries of promethium 147 inserted into said small portion of said vial means that extends into said first cylindrical guide, said promethium 147 enhancing the starting characteristics of said RF priming signal.

5. An RF-primed high power halogen vial apparatus as described in claim 3 wherein said first cylindrical guide has a diameter that is greater than the diameter of said second cylindrical guide.

6. An RF-primed high power halogen vial apparatus as described in claim 3 wherein said RF priming signal has a power strength of approximately five watts CW.

7. An RF-primed high power halogen vial apparatus as described in claim 3 wherein said RF priming signal has a predetermined frequency such that it will propagate into and through said first cylindrical guide but not through or out of said second cylindrical guide.

* * * * *